US009898928B1

(12) United States Patent
Payne

(10) Patent No.: US 9,898,928 B1
(45) Date of Patent: Feb. 20, 2018

(54) COASTING GUIDANCE TIMING AND LEARNING BASED ON APPROACH LANE

(71) Applicant: Toyota Motor Engineering & Manufacturing North America, Inc., Erlanger, KY (US)

(72) Inventor: Joshua D. Payne, Ann Arbor, MI (US)

(73) Assignee: TOYOTA MOTOR ENGINEERING & MANUFACTURING NORTH AMERICA, INC., Erlanger, KY (US)

( * ) Notice: Subject to any disclaimer, the term of this patent is extended or adjusted under 35 U.S.C. 154(b) by 0 days.

(21) Appl. No.: 15/334,224

(22) Filed: Oct. 25, 2016

(51) Int. Cl.
*G08G 1/09* (2006.01)
*G08G 1/0967* (2006.01)
*G08G 1/01* (2006.01)

(52) U.S. Cl.
CPC ..... *G08G 1/0967* (2013.01); *G08G 1/0112* (2013.01)

(58) Field of Classification Search
CPC ..... B60W 50/14; B60K 2350/1092; G08G 1/0967; G08G 1/0112
USPC ..... 340/901, 905, 435, 439; 701/1, 70, 93, 701/99
See application file for complete search history.

(56) References Cited

U.S. PATENT DOCUMENTS 5,239,472 A 8/1993 Long et al.
5,521,579 A 5/1996 Bernhard
5,521,823 A 5/1996 Akita et al.
5,815,072 A 9/1998 Yamanaka et al.
5,838,259 A 11/1998 Tonkin
6,208,927 B1 3/2001 Mine et al.
6,321,158 B1 11/2001 DeLorme et al.
6,336,038 B1 1/2002 Nojima et al.
6,584,395 B2 6/2003 Satou et al.
6,681,170 B2 1/2004 Winner et al.
(Continued)

FOREIGN PATENT DOCUMENTS

DE 102010038106 4/2012
DE 102011083013 3/2013
EP 2790950 7/2015

OTHER PUBLICATIONS

Kircher et al. "Continuous Versus Intermittent Presentation of Visual Eco-Driving Advice" *VTI* (*Swedish National Road and Transport Research Institute*); Transportation Research Part F 24; pp. 27-38; 2014.

(Continued)

*Primary Examiner* — Thomas Mullen
(74) *Attorney, Agent, or Firm* — Snell & Wilmer LLP

(57) ABSTRACT

Methods, systems, and apparatus for adjusting coasting guidance and control to the driver of a vehicle to improve fuel efficiency. The coasting guidance system includes a user interface for displaying coasting information. The coasting guidance system includes an electronic control unit (ECU) coupled to the user interface. The ECU is configured to obtain a current location of the vehicle and a location of a respective lane of a plurality of lanes. The ECU is configured to determine that the vehicle is travelling in the respective lane based on the current location of the vehicle and location of the respective lane. The ECU is configured to determine a stop area of the respective lane and determine an ideal coasting location based on the stop area. The ECU is configured to provide a notification to begin coasting at or within a threshold distance of the ideal coasting location.

20 Claims, 5 Drawing Sheets

(56) References Cited

U.S. PATENT DOCUMENTS

| | | | |
|---|---|---|---|
| 6,694,806 | B2 | 2/2004 | Kumagai et al. |
| 6,711,474 | B1 | 3/2004 | Treyz et al. |
| 6,871,145 | B2 | 3/2005 | Altan et al. |
| 7,212,905 | B2 | 5/2007 | Grill |
| 7,237,203 | B1 | 6/2007 | Kuenzner |
| 7,331,899 | B2 | 2/2008 | Ortmann et al. |
| 7,404,784 | B2 | 7/2008 | De Mersseman |
| 7,848,867 | B2 | 12/2010 | Ueno |
| 8,083,015 | B2 | 12/2011 | Kobayashi |
| 8,140,265 | B2 | 3/2012 | Grush |
| 8,185,296 | B2 | 5/2012 | Yokoyama et al. |
| 8,187,149 | B2 | 5/2012 | Koenig et al. |
| 8,204,665 | B2 | 6/2012 | Takeuchi et al. |
| 8,246,506 | B2 | 8/2012 | Matsubara et al. |
| 8,290,637 | B2 | 10/2012 | Krupadanam et al. |
| 8,384,532 | B2 | 2/2013 | Szczerba et al. |
| 8,483,949 | B2 | 7/2013 | Taguchi et al. |
| 8,538,462 | B2 | 9/2013 | Forstall et al. |
| 8,670,888 | B1 | 3/2014 | Brenner |
| 8,680,979 | B2 | 3/2014 | Hoffmeister |
| 8,706,379 | B2 | 4/2014 | Jang |
| 8,718,891 | B2 | 5/2014 | DeWitt et al. |
| 8,731,788 | B2 | 5/2014 | Sujan et al. |
| 8,742,908 | B2 | 6/2014 | Boudy |
| 8,764,124 | B2 | 7/2014 | Furuyama |
| 8,767,379 | B2 | 7/2014 | Whitaker |
| 8,784,267 | B2 | 7/2014 | Staudinger et al. |
| 8,849,507 | B2 | 9/2014 | Popp et al. |
| 8,917,171 | B2 | 12/2014 | Anderson et al. |
| 8,966,654 | B1 | 2/2015 | Kwak |
| 8,994,524 | B2 | 3/2015 | Fritz et al. |
| 9,013,292 | B2 | 4/2015 | Aberizk |
| 9,026,348 | B2 | 5/2015 | Ichinokawa |
| 9,050,935 | B2 | 6/2015 | Stefan et al. |
| 9,052,713 | B2 | 6/2015 | Schulz et al. |
| 9,073,540 | B2 | 7/2015 | Cauthen |
| 9,108,570 | B2 | 8/2015 | Giangrande |
| 9,121,719 | B2 | 9/2015 | Stankoulov |
| 9,168,896 | B2 | 10/2015 | Kim |
| 9,205,740 | B2 | 12/2015 | Jacobi et al. |
| 9,205,843 | B2 | 12/2015 | Sannodo et al. |
| 9,207,091 | B2 | 12/2015 | Ota et al. |
| 9,227,626 | B2 | 1/2016 | Pandit et al. |
| 9,229,457 | B2 | 1/2016 | Huelsebusch et al. |
| 9,238,412 | B2 | 1/2016 | Kidston et al. |
| 9,242,631 | B2 | 1/2016 | Tanaka et al. |
| 9,327,730 | B2 | 5/2016 | Miller et al. |
| 9,347,784 | B2 | 5/2016 | Inoue et al. |
| 2006/0125616 | A1 | 7/2006 | Song |
| 2006/0190173 | A1 | 8/2006 | Ogura |
| 2006/0290202 | A1 | 12/2006 | Shibata et al. |
| 2007/0102208 | A1 | 5/2007 | Okuda et al. |
| 2007/0129012 | A1 | 7/2007 | Snow |
| 2008/0201050 | A1 | 8/2008 | Placke et al. |
| 2010/0201505 | A1 | 8/2010 | Honary et al. |
| 2010/0256848 | A1 | 10/2010 | Sasaki et al. |
| 2011/0187520 | A1 | 8/2011 | Filev et al. |
| 2012/0078496 | A1 | 3/2012 | Lindhuber et al. |
| 2012/0095670 | A1 | 4/2012 | Piggott |
| 2012/0330505 | A1 | 12/2012 | Tsumori et al. |
| 2013/0162009 | A1 | 6/2013 | Mitts et al. |
| 2013/0268162 | A1 | 10/2013 | Ponziani |
| 2013/0274958 | A1 | 10/2013 | Uno |
| 2014/0067225 | A1 | 3/2014 | Lee et al. |
| 2014/0156171 | A1 | 6/2014 | Kono et al. |
| 2014/0156188 | A1 | 6/2014 | Hart et al. |
| 2014/0172208 | A1 | 6/2014 | Limbacher et al. |
| 2014/0324317 | A1 | 10/2014 | Schilling et al. |
| 2014/0335994 | A1 | 11/2014 | Otake |
| 2015/0232099 | A1* | 8/2015 | Miller ..... B60W 10/18 701/70 |
| 2015/0259008 | A1 | 9/2015 | Seguchi |
| 2015/0274169 | A1 | 10/2015 | Attard et al. |
| 2015/0307097 | A1 | 10/2015 | Steinmeyer et al. |
| 2015/0329119 | A1 | 11/2015 | Sujan et al. |
| 2015/0337789 | A1 | 11/2015 | Matsunaga et al. |
| 2016/0050315 | A1 | 2/2016 | Malhotra et al. |
| 2016/0059864 | A1 | 3/2016 | Feit et al. |
| 2016/0101780 | A1 | 4/2016 | Park |
| 2016/0107527 | A1 | 4/2016 | Amano |
| 2017/0080806 | A1* | 3/2017 | Woo ..... B60W 50/14 |

OTHER PUBLICATIONS

Kleine-Besten et al. "Navigation and Transport Telematics" *Handbook of Driver Assistance Systems*; pp. 1-35, 2015.

Koopmann et al. "Identification of Traffic States from Onboard Vehicle Sensors" *SAE International*; 8 pages; Aug. 7, 2016.

Leonard et al. "A Perception-Driven Autonomous Urban Vehicle" *Journal of Field Robotics*; vol. 25 No. 10; pp. 727-774; 2008.

Nozaki et al. "Effect of Active Effort in Eco-Driving Support System on Proficiency of Driving Skill" *SICE Annual Conference 2012*; pp. 646-651; 2012.

Seewald et al. "D13.1: Evaluation Plan and Scenario Definition" *ecoDriver Project* Retrieved from www.ecodriver-project.eu; Version 9; pp. 1-173; Mar. 10, 2014.

* cited by examiner

COASTING GUIDANCE TIMING AND LEARNING BASED ON APPROACH LANE

BACKGROUND

1. Field

This specification relates to a system and a method for providing coasting guidance and control to the driver of a vehicle to improve fuel efficiency.

2. Description of the Related Art

Drivers may increase fuel efficiency by adjusting or changing their driving behavior. For example, a driver may coast while driving to conserve fuel. Vehicle coasting involves allowing the vehicle to progress, propel or otherwise move without use of propelling power. That is, the driver may drive without engaging the vehicle's engine or battery. For example, the vehicle may move using inertia and/or gravity. By relying on inertia and/or gravity to propel the vehicle, the vehicle does not consume fuel or electrical energy to propel the vehicle.

A vehicle that coasts towards a stop sign may require additional braking to completely stop or slow the vehicle. A driver lacks the ability to gauge when to begin coasting to stop at or within proximity of the stop sign. For example, if the driver begins to coast too early, the vehicle may stop before reaching the stop sign or if the driver begins to coast too late, the driver may have to apply both the regenerative brakes and/or energy dissipation brakes, such as hydraulic brakes or friction brakes, to stop at the stop sign. The application of energy dissipation brakes results in the loss of energy that could have been captured by the regenerative brakes and stored.

Additionally, when there are multiple lanes in the roadway each lane may have a different type of stop event, such as a stop sign, a yield sign, or a traffic signal, the location where the driver may want to stop may vary across the different lanes. For example, a driver in a first lane may be approaching a traffic signal with a green left turn signal while a driver in a second lane may be approaching a traffic signal with a red light and so the driver in the first lane will plan on stopping in the middle of the intersection to make the left turn while the driver in the second lane will plan on stopping at the entrance of the intersection. As such, the driver in the first lane will want to begin coasting later than the driver in the second lane to increase fuel efficiency.

Accordingly, there is a need for a system and a method for providing coasting guidance and control to the driver to adjust for different stopping behaviors associated with different lanes of the vehicle to improve fuel efficiency.

SUMMARY

In general, one aspect of the subject matter described in this specification is embodied in a coasting guidance system for a vehicle. The coasting guidance system includes a user interface for displaying coasting information. The coasting guidance system includes an electronic control unit coupled to the user interface. The electronic control unit is configured to obtain a current location of the vehicle and a location of a respective lane of multiple lanes. The electronic control unit is configured to determine that the vehicle is travelling in the respective lane based on the current location of the vehicle and location of the respective lane. The electronic control unit is configured to determine a stop area of the respective lane and determine an ideal coasting location based on the stop area. The electronic control unit is configured to provide a notification to begin coasting at or within a threshold distance of the ideal coasting location.

These and other embodiments may optionally include one or more of the following features. Each lane of the multiple lanes may have a stop area. The stop area of each lane of the multiple lanes may be different than at least one other stop area of another lane of the multiple lanes. The electronic control unit may be configured to determine the stop area based on a location of a stop event. The stop area may begin a first distance before the stop event and may extend a second distance past the stop event. The stop event may be of a particular type of multiple types. The electronic control unit may be configured to determine the stop area of the respective lane further based on the particular type.

The coasting guidance system may include one or more external databases for providing navigational map information and traffic condition information. The electronic control unit may be configured to obtain navigational map information and traffic condition information from the one or more external databases. The electronic control unit may determine the location of the stop event from the navigational map information. The electronic control unit may be configured to determine that a roadway has multiple locations based on the navigational map information.

The coasting guidance system may include at least one or more external databases or one or more sensors configured to detect traffic in the respective lane. The electronic control unit may be further coupled to the at least one of the one or more external databases or the one or more sensors and may be further configured to determine the stop area for the respective lane based on the detected traffic in the respective lane. The coasting guidance system may include a navigation unit. The navigation unit may be configured to obtain a current location of the vehicle. The coasting guidance system may include a memory configured to store multiple locations of stop events. The electronic control unit may be configured to compare the current location of the vehicle with each stored location of the multiple locations of stop events stored in the memory and match the current location of the vehicle to one of the multiple stored locations of stop events to determine the location of the stop area. The notification may indicate to the driver that the driver should begin to coast.

In another aspect, the subject matter is embodied in a method to notify a driver of a vehicle to begin coasting. The method may include obtaining vehicle information and navigational map information. The navigational map including lane information. The method may include determining a location of a stop area of the respective lane of the multiple lanes. Each lane of the multiple lanes may have a stop area. The stop area of the respective lane may be different than at least one stop area of another lane of the multiple lanes. The method may include determining an ideal coasting location based on the stop area of the respective lane. The method may include providing a notification to begin coasting at or within proximity of the ideal coasting location.

In another aspect, the subject matter is embodied in a coasting guidance system of a vehicle. The coasting guidance system may include a user interface for displaying coasting information and an electronic control unit. The electronic control unit may be coupled to the user interface and may be configured to determine that a roadway has multiple lanes. The electronic control unit may determine a location of a stop event for the respective lane of the multiple lanes that the vehicle is travelling in. The coasting guidance system may determine a stop area of the respective lane. The coasting guidance system may determine an ideal coasting location based on the stop area of the respective lane and may provide a notification to the user interface to begin coasting at or within proximity of the ideal coasting location.

BRIEF DESCRIPTION OF THE DRAWINGS

Other systems, methods, features, and advantages of the present invention will be apparent to one skilled in the art upon examination of the following figures and detailed description. Component parts shown in the drawings are not necessarily to scale, and may be exaggerated to better illustrate the important features of the present invention.

DETAILED DESCRIPTION

Disclosed herein are systems, vehicles and methods providing coasting guidance and control to the driver of a vehicle to improve fuel efficiency. Particular embodiments of the subject matter described in this specification may be implemented to realize one or more of the following advantages. A coasting guidance and control system ("coasting guidance system") for notifying a driver of an ideal coasting location based on the vehicle's lane and specific conditions associated with the vehicle's lane. The coasting guidance system compensates for different driving situations associated with different lanes of a roadway. By compensating for the different driving situations, the coasting guidance system maximizes coasting of the vehicle and/or improves driver comfort. For example, when a there is a three lane roadway and one or more vehicles approach a traffic signal, the traffic signal may have a green left turn signal for the left lane and a red light signal for the other two lanes. The stop area of the vehicle in the left turn lane would be in the middle of the intersection to allow the driver to stop in the middle of the intersection to make a left turn, whereas, the stop area of the other vehicles in the other two lanes would be closer to the entrance of the intersection so as not to enter the intersection. By adjusting the stop area of the left turn lane, the driver of the vehicle in the left turn lane may delay coasting.

Other benefits and advantages include the capability to adjust the location of the stop area based on traffic within the vehicle's lane. By accounting for traffic, the coasting guidance system may more accurately determine the location of the stop area so that the driver does not have to brake suddenly as a result of traffic being backed up. For example, if there are multiple vehicles in the lane stopped at a traffic signal, the coasting guidance system may adjust the stop area so that the location of the stop event is a threshold distance behind the last vehicle stopped at the traffic signal. The driver is notified earlier so that the driver may coast earlier to maximize fuel efficiency.

Additionally, the coasting guidance system may adjust the timing of the notification sent to the driver to begin coasting to improve the fuel efficiency of the vehicle.

Figure 1:
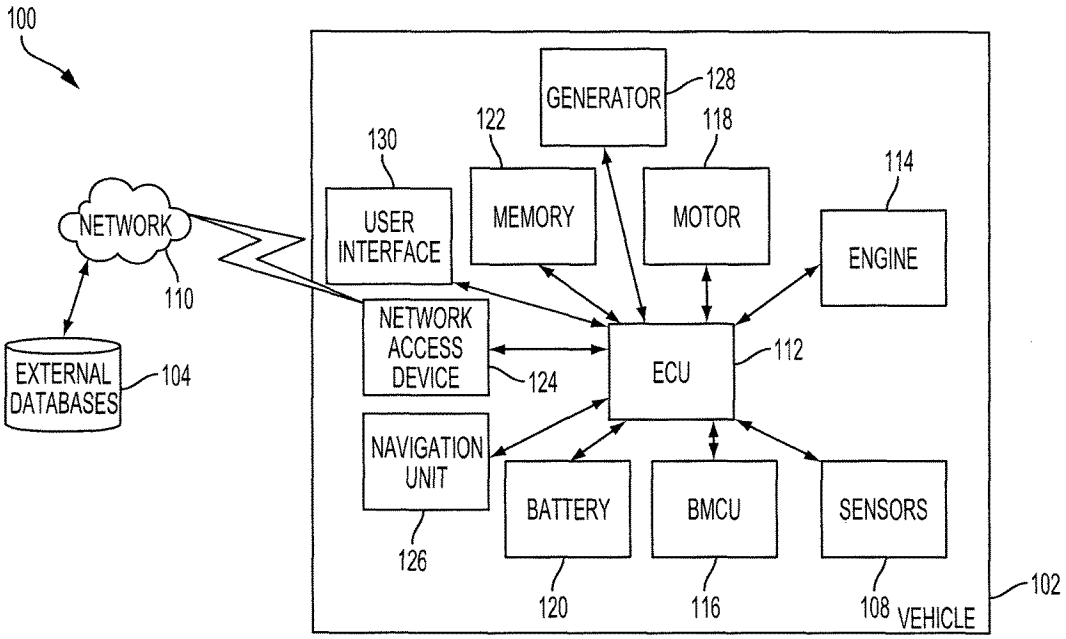
FIG. 1 is a block diagram of an example coasting guidance system for a vehicle according to an aspect of the invention.

FIG. 1 is a block diagram of an example coasting guidance system 100 for a vehicle 102. The coasting guidance system 100 may include one or more computers or electronic control units (ECUs) 112, appropriately programmed, to control coasting in the vehicle 102. The coasting guidance system 100 may include a navigation unit 126, a user interface 130, a memory 122, one or more sensors 108, and/or a network access device 124.

Coasting involves the propulsion of the vehicle 102 without the use of fuel or electrical energy. Other forms of energy, such as inertia or gravity, may propel the vehicle 102. The coasting guidance system 100 may provide coasting information to a driver, for example, through the user interface 130. The coasting information may include notifications, such as a notification that indicates to the driver to begin coasting, energy and mileage information related to the coasting, and/or distance information to an ideal coasting location and/or a braking location. The coasting guidance system 100 may control a deceleration drive force that controls the deceleration of a vehicle 102 while coasting.

The coasting guidance system 100 may be included in a vehicle 102 and connected to one or more external databases 104 through a network 110. A vehicle 102 is a conveyance capable of transporting a person, an object, or a permanently or temporarily affixed apparatus. A vehicle 102 may be a self-propelled wheeled conveyance, such as a car, sports utility vehicle, truck, bus, van or other motor or battery driven vehicle. For example, the vehicle 102 may be an electric vehicle, a hybrid vehicle, a plug-in hybrid vehicle or any other type of vehicle that includes a motor 118 and/or generator 128. Other examples of vehicles include bicycles, trains, planes, or boats, and any other form of conveyance that is capable of transportation. The vehicle 102 may be semi-autonomous or autonomous. That is, the vehicle 102 may be self-maneuvering and navigate without human input. An autonomous vehicle may use one or more sensors 108 and/or navigation unit 126 to drive autonomously.

The vehicle 102 may be coupled to a network 110. The network 110, such as a local area network (LAN), a wide area network (WAN), a cellular network, a digital short-range communication (DSRC), the Internet, or a combination thereof, connects the vehicle 102 and/or coasting guidance system 100 to the one or more external databases 104. The external databases 104 may include databases from different service providers. A service provider may provide navigational map, weather and/or traffic condition information to the vehicle 102.

A database is any collection of pieces of information that is organized for search and retrieval, such as by a computer, and the database may be organized in tables, schemas, queries, report, or any other data structures. A database may use any number of database management systems. An external database 104 may include a third-party server or website that stores or provides information. The information may include real-time information, periodically updated information, or user-inputted information. A server may be a computer in a network that is used to provide services, such as accessing files or sharing peripherals, to other computers in the network. A website may be a collection of one or more resources associated with a domain name.

Navigational map information may include political, traffic condition, roadway and construction information. Political information includes political features such as cities, states, zoning ordinances, and laws and regulations, and traffic signs. Roadway information includes road features such the grade of an incline of a road and/or the boundaries of one or more lanes that make up the roadway. Construction information includes construction features such as construction zones and construction hazards.

Traffic condition information includes one or more traffic condition features, such as a stop sign, traffic signal, traffic congested areas or accident areas. The traffic condition information may provide information related to the density and movement of vehicles on a roadway and/or accident locations. Traffic condition information may include real-time information of the traffic congested areas or accident areas. The real-time information may include the traffic in a particular lane. The traffic condition information may include state information of traffic signals, such as the state of a traffic signal. For example, real-time information of the color of a traffic signal may be obtained from a transportation system.

Features, e.g., road features, political features, or traffic condition features, each have a location that may be identified by map coordinates. The map coordinates may be defined by latitude and longitudinal coordinates.

The vehicle 102 may include an engine 114, a motor 118, a generator 128, battery 120 and a battery management and control unit (BMCU) 116. The motor 118 and/or generator 128 may be an electric motor and an electric generator that converts electrical energy into mechanical power, such as torque, and converts mechanical power into electrical energy. The motor 118 and/or generator 128 may be coupled to the battery 120. The motor 118 and/or generator 128 may convert the energy from the battery 120 into mechanical power, and may provide energy back to the battery 120, for example, via regenerative braking. In some implementations, the vehicle 102 may include one or more additional power generation devices, such as the engine 114. The engine 114 combusts fuel to provide power instead of and/or in addition to the power supplied by the motor 118 and/or generator 128.

The battery 120 may be coupled to the motor 118 and/or generator 128 and may provide electrical energy to and receive electrical energy from the motor 118 and/or generator 128. The battery 120 may include one or more rechargeable batteries.

The BMCU 116 may be coupled to the battery 120 and control and manage the charging and discharging of the battery 120. The BMCU 116, for example, may measure, using battery sensors (not shown), parameters used to determine the state of charge (SOC) of the battery 120.

The one or more ECUs 112 may be implemented as a single ECU or in multiple ECUs. The ECU 112 may be electrically coupled to some or all of the components of the vehicle 102. The ECU may be coupled to at least one of the navigation unit 126, the one or more sensors 108, the network access device 124 or the memory 122. The ECU 112 may include one or more processors or controllers specifically designed for controlling one or more coasting guidance features, such as adjusting the stop area of a stop event based on the lane of the vehicle 102.

The memory 122 may be coupled to the ECU 112. The memory 122 may store instructions to execute on the ECU 112 and may include one or more of a RAM or other volatile or non-volatile memory. The memory 122 may be a non-transitory memory or a data storage device, such as a hard disk drive, a solid-state disk drive, a hybrid disk drive, or other appropriate data storage, and may further store machine-readable instructions, which may be loaded and executed by the ECU 112. The memory 122 may store the location of stop events.

The network access device 124 may include a communication port or channel, such as one or more of a Wi-Fi unit, a Bluetooth® unit, a Radio Frequency Identification (RFID) tag or reader, a DSRC unit, or a cellular network unit for accessing a cellular network (such as 3G or 4G). The network access device 124 may transmit data to and receive data from devices and systems not directly connected to the vehicle 102. For example, the ECU 112 may communicate with the external databases 104. Furthermore, the network access device 124 may access the network 110, to which the external databases 104 are also connected.

The one or more sensors 108 may be coupled to the ECU 112 and include a vehicle speed sensor, an acceleration input sensor, a brake sensor, and/or one or more proximity sensors. The vehicle speed sensor measures the speed of the vehicle 102, for example, by measuring the total revolutions of the wheel per minute. The brake sensor measures the amount of pressure applied to the brake pedal. The acceleration input sensor measures the amount of pressure applied to the accelerator pedal. The one or more proximity sensors may be positioned on the front and/or rear of the vehicle 102 to detect surrounding vehicles and/or objects that are within a threshold distance of the vehicle 102 in the front and/or back of the vehicle 102, respectively. The proximity sensor may use radar, a camera, vehicle-to-vehicle (V2V) communication or other means to detect and/or measure a distance to the other vehicles or objects. The one or more sensors 108 may include one or more cameras that may be used to identify a driver to determine driver specific configurations to control the vehicle 102.

The navigation unit 126 may be coupled to the ECU 112 and provide vehicle information and/or navigation information to the ECU 112. The vehicle information may include the current location, direction and/or speed of the vehicle 102. The navigation information may include a route that the vehicle 102 is or will be travelling. The route may include a starting location, a destination location and/or a path between the starting location and the destination location.

Figure 2:
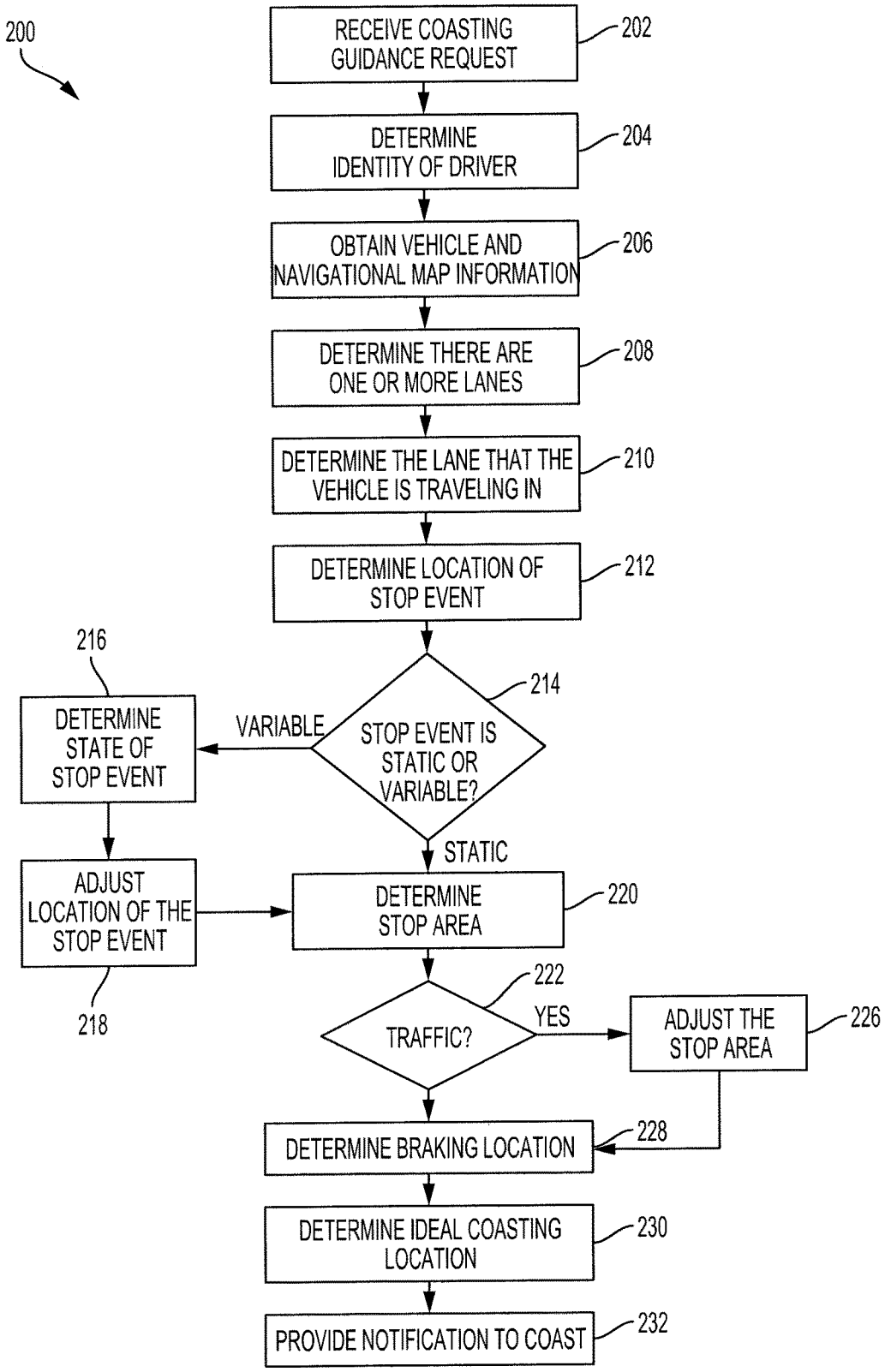
FIG. 2 is a flow diagram of an example process for providing a notification to the driver to coast based on the lane of the vehicle according to an aspect of the invention.

FIG. 2 is a flow diagram of an example process 200 for notifying the driver to coast. One or more computers or one or more data processing apparatuses, for example, the ECU 112 of the coasting guidance system 100 of FIG. 1, appropriately programmed, may implement the process 200.

The coasting guidance system 100 receives a coasting guidance request (202). The coasting guidance request is a request to initialize the coasting guidance system 100. The coasting guidance system 100 receives the coasting guidance request when the vehicle 102 becomes operational or when an occupant of the vehicle 102 activates the coasting guidance system 100.

The coasting guidance system 100 may receive the coasting guidance request from one or more sensors 108, such as an engine sensor, when the vehicle 102 is powered on. The coasting guidance system 100 may receive the coasting guidance request upon user activation, for example, when a token, such as a key, is inserted to start the vehicle 102.

The coasting guidance system 100 may determine an identity of a driver during initialization (204). The coasting guidance request may include the identity of the driver. The coasting guidance system 100 may receive user input, such as a user identification token, a user id or a fingerprint, which identifies the driver, to determine the identity of the driver. For example, a driver's key fob may uniquely identify the driver when the driver opens the door or is within proximity of the vehicle 102. In another example, the coasting guidance system 100 may obtain a user id from the driver, using the user interface 130, to identify the driver. The coasting guidance system 100 may use other user interface elements, such as a memory button that configures the position of a mirror or a seat, other sensors, such as a camera that uses facial recognition, or a combination of devices and/or techniques to identify the driver of the vehicle 102. The identity of the driver may be associated with a driver response time that is stored in the memory 122.

The coasting guidance system 100 obtains the vehicle information and the navigational map information (206). The coasting guidance system 100 may obtain the vehicle information from the navigation unit 126. For example, the navigation unit 126 may include a global positioning system (GPS) device that may track and provide a current location of the vehicle 102 and/or a current speed of the vehicle 102. In some implementations, the coasting guidance system 100 may obtain the vehicle information from a vehicle speed sensor that may provide the current speed of the vehicle 102.

The coasting guidance system 100 may obtain the navigational map information from the one or more external databases 104 through the navigation unit 126 and/or the ECU 112. The navigational map information includes the political, traffic condition, roadway and construction information. The navigation unit 126 and/or the ECU 112 may request navigation map information from the one or more external databases 104 through the network 110 and may receive a response with the navigational map information from the one or more external databases 104.

The coasting guidance system 100 determines that there are one or more lanes at a current location of the vehicle 102 (208). The coasting guidance system 100 may determine that there are multiple lanes based on the navigation map information. The navigational map information may include high fidelity maps and/or images that may differentiate different lanes of a roadway. The coasting guidance system 100 may analyze the high fidelity maps and/or images to determine that there are multiple lanes. For example, the coasting guidance system 100 may map discrete points on the high fidelity maps and/or images to mark the boundaries of each lane, and may use the discrete points to differentiate the different lanes.

In some implementations, the coasting guidance system 100 determines that there are multiple lanes based on lane markers that identify the boundaries of each lane. The coasting guidance system 100 may identify the lane markers using one or more sensors 108. The lane markers may be embedded in the roadway which the coasting guidance system 100 may detect using the one or more sensors 108.

The coasting guidance system 100 may determine the lane that the vehicle 102 is travelling in based on the navigational map information and/or the vehicle information (210). The vehicle information may include a current location of the vehicle 102. A current location of the vehicle 102 may include map coordinates of the vehicle 102 that indicate the location of the vehicle 102 on a roadway relative to a route being traveled by the vehicle 102. The current location of the vehicle 102 may indicate the location of the vehicle 102 within a roadway, such as the lane the vehicle 102 is travelling in. For example, the current location of the vehicle 102 may include the location of the vehicle 102 relative to one or more lane markers. The one or more lane markers may be identified from high fidelity maps and/or images included in the navigational map information or from images captured by one or more sensors 108, such as one or more cameras, of the vehicle 102.

The coasting guidance system 100 determines the location of an approaching stop event for the particular lane that the vehicle 102 is travelling in (212). A stop event may be a stop sign, a traffic signal, an accident location and/or a location where traffic is at a standstill. An approaching stop event is a stop event on the route of the vehicle 102 that the vehicle 102 is travelling towards. A stop event may be of a particular type, such as a variable stop event or a static stop event. A static stop event does not change states, e.g., a stop sign or a dead end. A variable stop event does change states, e.g., backed-up or standstill traffic or a traffic signal that rotates between different colors or signals. A variable stop event may have different states, such as a green left turn signal for a traffic signal or a red stop signal. The coasting guidance system 100 may extract the location of the stop event from the navigational map information. The navigation unit 126 may obtain navigational map information including the locations of one or more stop events that are near the current location of the vehicle 102, such as a stop sign, traffic, or a red traffic signal, from one or more external databases 104 via the network 110.

The location of a stop event may be different across the different lanes of a roadway. The different locations of the stop events may result in different stop areas for the different lanes. For example, a first lane of the roadway may have a stop event closer to the middle of the intersection since vehicles may stop near the middle of the intersection to make a left turn and a second lane of the roadway may have a stop event located near the entrance of the intersection. As a result, the coasting guidance system 100 may have learned and stored a stop event closer to the middle of the intersection for the first lane and at the entrance of the intersection for the second lane.

The coasting guidance system 100 may determine the location of a stop event based on a stored location of a previously traveled stop event. In a previously traveled route, the coasting guidance system 100 may determine that the vehicle 102 is stopping based on the speed of the vehicle 102. That is, the coasting guidance system 100 may determine that the speed of the vehicle 102 is below a threshold speed, such as 4 mph, and is decreasing which may indicate that the vehicle is stopping. The coasting guidance system 100 may associate the location of the vehicle 102 with a stop event and store the stop event in the memory 122. The coasting guidance system 100 may compare the current location of the vehicle 102 with the location of the stored stop event on a subsequent route to identify the location of the stop event. The coordinates of the vehicle 102 that are associated with the stored stop event and the current location of the vehicle 102 may be obtained using the navigation unit 126.

The coasting guidance system 100 may count a number of times that the vehicle 102 stops or partially stops at a location or within a range of the location, and store the location as a stop event if the number of times that the vehicle 102 stops or partially stops at the location or within the range of the location is greater than or equal to a threshold value. A partial stop may be when the vehicle 102 slows down but does not completely stop. The coasting guidance system 100 may decrease the number of times that the vehicle 102 stops or partially stops at a location or within a range of the location if the vehicle 102 drives through the location without stopping or partially stopping. The coasting guidance system 100 may forget or remove a stored stop event from memory 122 if the number of times that the vehicle 102 stops or partially stops at a location or within the range of the location is less than a threshold value. The range may be a stop area that surrounds and includes the location of the stop event. The range may be a range of 40 meters, e.g., 35 meters prior to the location of the stop event and 5 meters after the location of the stop event. The memory 122 may store a mapping between the locations of the stop events, the frequency the vehicle 102 stops or partially stops, a state of the stop event, and/or a lane of the stop event.

In some implementations, the coasting guidance system 100 stores the state of a stop event along with the location of the stop event for a particular lane. When the coasting guidance system 100 determines the location of the stop event in a subsequently traveled route, the coasting guidance system 100 may adjust the location of the stop event for the particular route based on the state of the stop event. For example, if the left turn signal is red, the location of the stop event may be at the entrance of the intersection. If the left turn signal is green, the location of the stop event may be in the middle of the intersection. The two different locations for the stop event may be associated with the different color lights when stored.

In some implementations, one or more sensors 108 may detect if there are vehicles in front of the vehicle 102. If there are no vehicles in front of the vehicle 102, the coasting guidance system 100 may determine that the vehicle 102 is stopping due to a static stop event, such as a traffic sign, and not a variable stop event, such as traffic, that may be in a different state if the vehicle 102 subsequently travels the same route. The coasting guidance system 100 may differentiate between static and variable stop events when storing the stop events. The coasting guidance system 100 may use a combination of stored stop events and/or navigational map information to determine the location of one or more stop events.

The coasting guidance system 100 may determine whether the stop event is a static stop event or variable stop event (214). The coasting guidance system 100 may obtain the type of the stop event from the navigational map information, from stored information in memory 122, or from image data captured by one or more sensors 108, such as a camera. For example, the coasting guidance system 100 may extract from the navigational map information that an approaching stop event for the particular lane is a variable stop event, such as a traffic signal.

If the stop event is a variable stop event, the coasting guidance system 100 may determine the state of the stop event from the navigational map information by obtaining the state information from the one or more external databases 104, such a transportation system database (216). The coasting guidance system 100 may parse the information from the one or more external databases 104 to determine the state of the stop event. For example, a traffic signal at an intersection may have multiple states, such as a first state where the left-hand turn signal is green for the left turn lane and red for the other lanes. The traffic signal may have a second state where the traffic signal is red for all the lanes and a third state where the traffic signal is green for all the lanes. The coasting guidance system 100 may obtain from the one or more external databases 104 the current state of the particular traffic signal associated with the stop event and other traffic signal information including the remaining duration that the traffic signal will remain in the current state and the next state of the traffic signal.

The coasting guidance system 100 may anticipate the state of the stop event at the time the vehicle 102 is at or within a threshold distance of the stop event. The coasting guidance system 100 may anticipate the state of the stop event based on the current speed of the vehicle 102, a distance between the vehicle 102 and the location of the stop event and the traffic signal information. For example, if the coasting guidance system 100 calculates that the vehicle 102 will be at the location of the stop event in 4 seconds and the obtained traffic signal information indicates that the light will be red in the lane of the vehicle 102 in 3 seconds and last for 4 seconds, the coasting guidance system 100 may anticipate that the traffic signal will be red when the vehicle 102 is within a stop area of the stop event.

The coasting guidance system 100 may adjust the location of the stop event for the particular lane that the vehicle is travelling in based on the current state or anticipated state of the variable stop event (218). For example, the coasting guidance system 100 may adjust the location of the stop event from the entrance of an intersection to the middle of the intersection if the state of the stop event is a green left turn signal. The coasting guidance system 100 may compare the current location of the vehicle 102 with the locations of stop events stored in the memory 122 to identify the location of the stop event. The coasting guidance system 100 may compare the current state of the stop event with the stored states associated with the identified stop event and adjust the location of the stop event based on the matched location of the stop event with the same state.

The coasting guidance system 100 determines the stop area of the lane the vehicle 102 is travelling in (220). The stop area is based on the location of the stop event for the particular lane that the vehicle 102 is travelling in. The stop area for each lane may be different. The stop area may be based on the state of the stop event if the stop event is a variable stop event. For example, the stop area of a left turn lane will be approximately in the middle of the intersection if the traffic signal indicates a green left turn signal, but when the traffic signal indicates a red light, the stop area would end before the entrance of the intersection. The stop area may have a start location that is a threshold distance prior to the stop event and an end location that is a threshold distance after the stop event. The start location of the stop area may be a braking location and the end location may be the location of the stop event.

The coasting guidance system 100 may determine whether there is traffic within or encroaches into a particular lane that the vehicle 102 is travelling in (222). The coasting guidance system 100 may extract traffic condition information for the one or more lanes of the roadway from the navigational map information. The one or more lanes of the roadway include the particular lane that the vehicle 102 is travelling in and any adjacent lanes of the roadway. For example, the coasting guidance system 100 may obtain traffic condition information from an application, such as Waze®, or from a server, such as Google Maps®. The traffic condition information may include traffic density information or length of traffic that is at a standstill for each of the one or more lanes of the roadway. The traffic condition information may identify the number of vehicles stopped within the stop area of the particular lane and the distance the vehicles are backed-up. The coasting guidance system 100 may anticipate the number of vehicles that may stop within the stop area of the particular lane.

If there is traffic within the stop area or encroaches within the particular lane, the coasting guidance system 100 may adjust the stop area based on the traffic condition information (226). The coasting guidance system 100 may adjust the end location of the stop area by a distance that is greater than or equal to the length of the traffic. When a vehicle 102 is approaching the stop area, the one or more sensors 108, e.g., vehicle-to-vehicle (V2V) communication, a proximity sensor or a camera, may detect if there is a vehicle in front of the vehicle 102 that is at a standstill or moving at less than a threshold speed that may indicate that traffic in front of the vehicle 102 is at a standstill. The coasting guidance system 100 may adjust the stop area if there are vehicles at a standstill within the stop area. For example, the coasting guidance system 100 determines that two vehicles are at a standstill at an upcoming stop event for a particular lane that the vehicle 102 is travelling in. In response, the coasting guidance system 100 adjusts the location of the stop event for the particular lane by a length or an estimated length of the two vehicles that are stopped in the particular lane so that the notification to coast is provided earlier to the driver.

Traffic within the stop area may include traffic within an adjacent lane that encroaches on the particular lane that the vehicle 102 is travelling in. For example, a first lane that is a straight-away may branch into two lanes. The second adjacent lane may be used by vehicles to make a left-hand turn. The coasting guidance system 100 may detect that the vehicles in the second adjacent lane are backed-up and at a standstill causing one or more vehicles to encroach on the first lane. In response, the coasting guidance system 100 may adjust the stop area for the vehicle 102 that is travelling in the first lane so that the driver stops before reaching the encroaching vehicle.

The coasting guidance system 100 may determine a braking location based on the location of the stop area (228). The braking location may be the start location of the stop area. The braking location may be a location that maximizes the amount of energy that is recaptured by the regenerative brakes if the driver initiates braking at the braking location and the vehicle 102 is travelling at a target speed. That is, when the brake is depressed at the braking location when the vehicle 102 is travelling at the target speed, the driver fully realizes the capture of regenerative energy. In some implementations, the coasting guidance system 100 may compensate for a rolling stop when the coasting guidance system 100 determines the braking location and the target speed.

The coasting guidance system 100 determines an ideal coasting location based on a current speed of the vehicle 102 and the braking location (230). The ideal coasting location is the location that maximizes coasting of the vehicle 102 to decelerate to the target speed at the braking location. The coasting guidance system 100 determines an ideal coasting location by calculating the distance needed for the vehicle 102 to decelerate using a pre-set deceleration drive force to reach the target speed at the braking location. The pre-set deceleration drive force may be based on a deceleration map and the current speed of the vehicle 102. In some implementations, the braking location and the location of the stop event are the same location, and the target speed is 0 mph.

The coasting guidance system 100 may provide a notification to the driver to coast at or within a threshold distance of the ideal coasting location (232). The coasting guidance system 100 provides a notification to the driver that indicates to the driver to begin coasting when the vehicle 102 is at or within a threshold distance of the ideal coasting location. The coasting guidance system 100 compares the current location of the vehicle 102 to the ideal coasting location. If the current location of the vehicle 102 is at or within a threshold distance of the ideal coasting location, the coasting guidance system 100 notifies the driver to begin coasting, for example, through the user interface 130. The threshold distance may be based on a driver response associated with an identity of the driver or may be pre-set.

Figure 3:
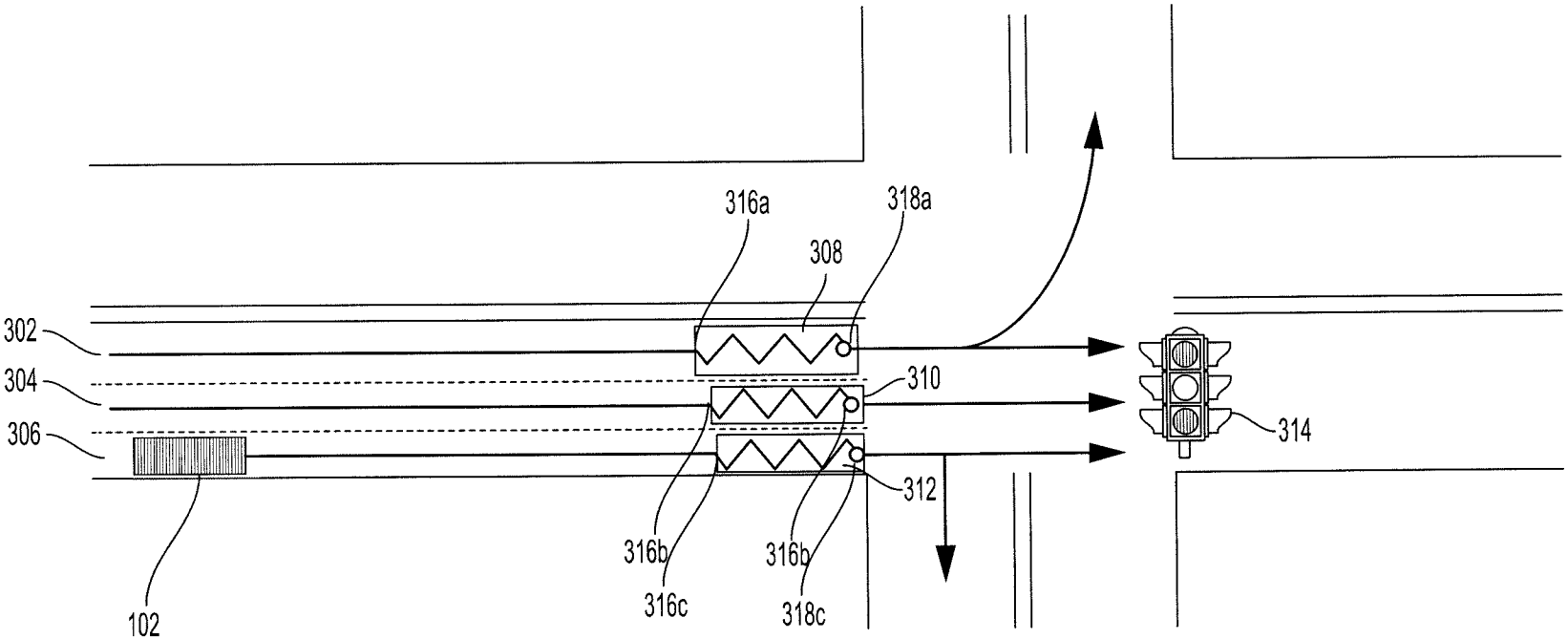
FIG. 3 is an example illustration of a stopping area for one or more vehicles for a first state of a stop event according to an aspect of the invention.

FIG. 3 is an illustration of a stopping area for one or more vehicles for a first state of a stop event 314, such as a traffic light. The first state of the stop event 314 may be a red light for a first lane 302, a second lane 304 and a third lane 306. Lanes 302, 304 and 306 may have stop areas 308, 310 and 312, respectively. The stop areas 308, 310 and 312 may be approximately in the same region having the same starting locations and the same end locations. The end location of the lanes 302, 304 and 306 may be at the entrance of the intersection because the stop event 314 is in the first state that is a red light for all three lanes 302, 304 and 306. The start locations of the stop areas 308, 310, and 312 may be the braking locations 316*a-c*, respectively, and the end locations may be the locations 318*a-c* of the stop event 314.

Figure 4:
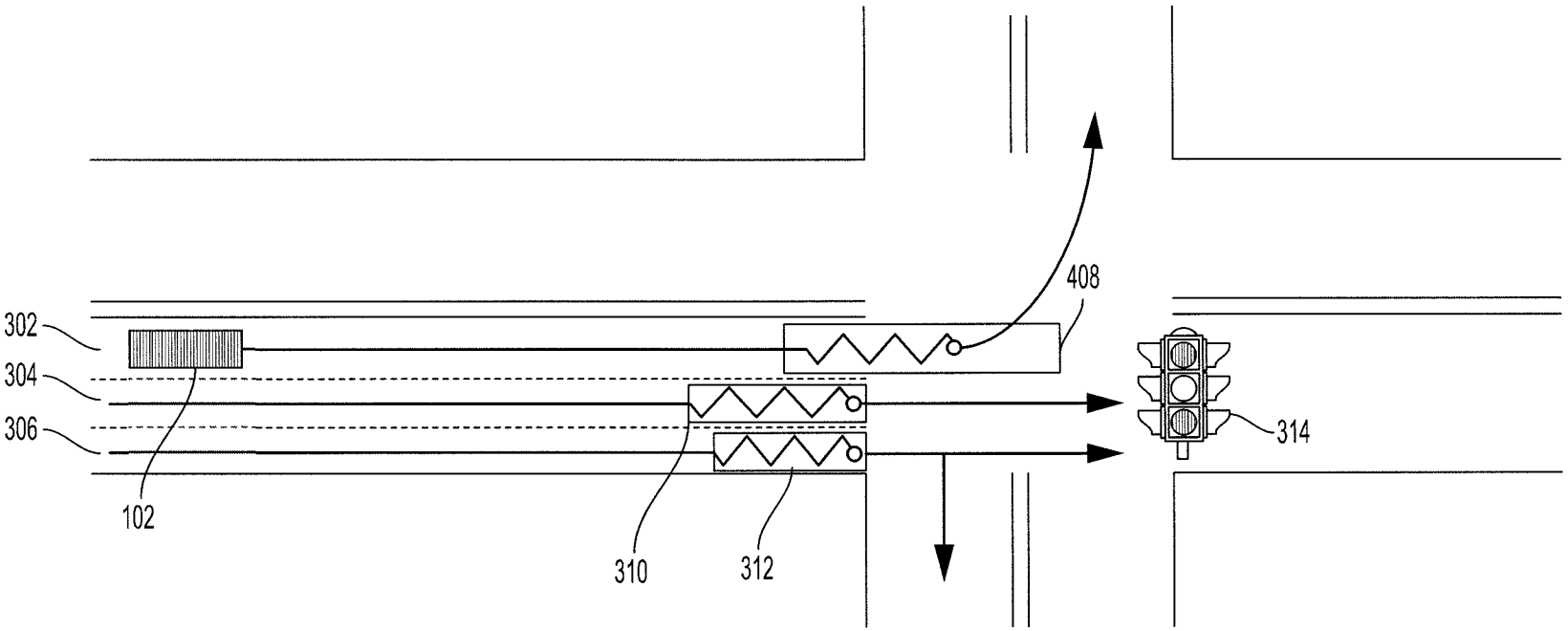
FIG. 4 is an example illustration of a stopping area for one or more vehicles for a second state of a stop event according to an aspect of the invention.

FIG. 4 is an illustration of a stopping area for one or more vehicles for a second state of a stop event 314. The second state of the stop event 314 may be a green left turn signal for a first lane 302, a red light signal for a second lane 304, and a red light signal for a third lane 306. Lanes 302, 304 and 306 may have stop areas 408, 310 and 312, respectively. The stop areas 310, 312 may be approximately in the same region with end locations near the entrance of the intersection, as both lanes 302, 304 have a red light signal. The start locations of the stop areas 310, 312 for the lanes 304, 306 may be before the entrance of the intersection so that the vehicle 102 may reach a complete or partial stop before reaching the entrance of the intersection. The stop area 408 for the lane 302 may encroach within the intersection so that the vehicle 102 may coast until reaching the stop area 408. The vehicle 102 may come to a stop in a location near the middle of the intersection to make a left turn.

Figure 5:
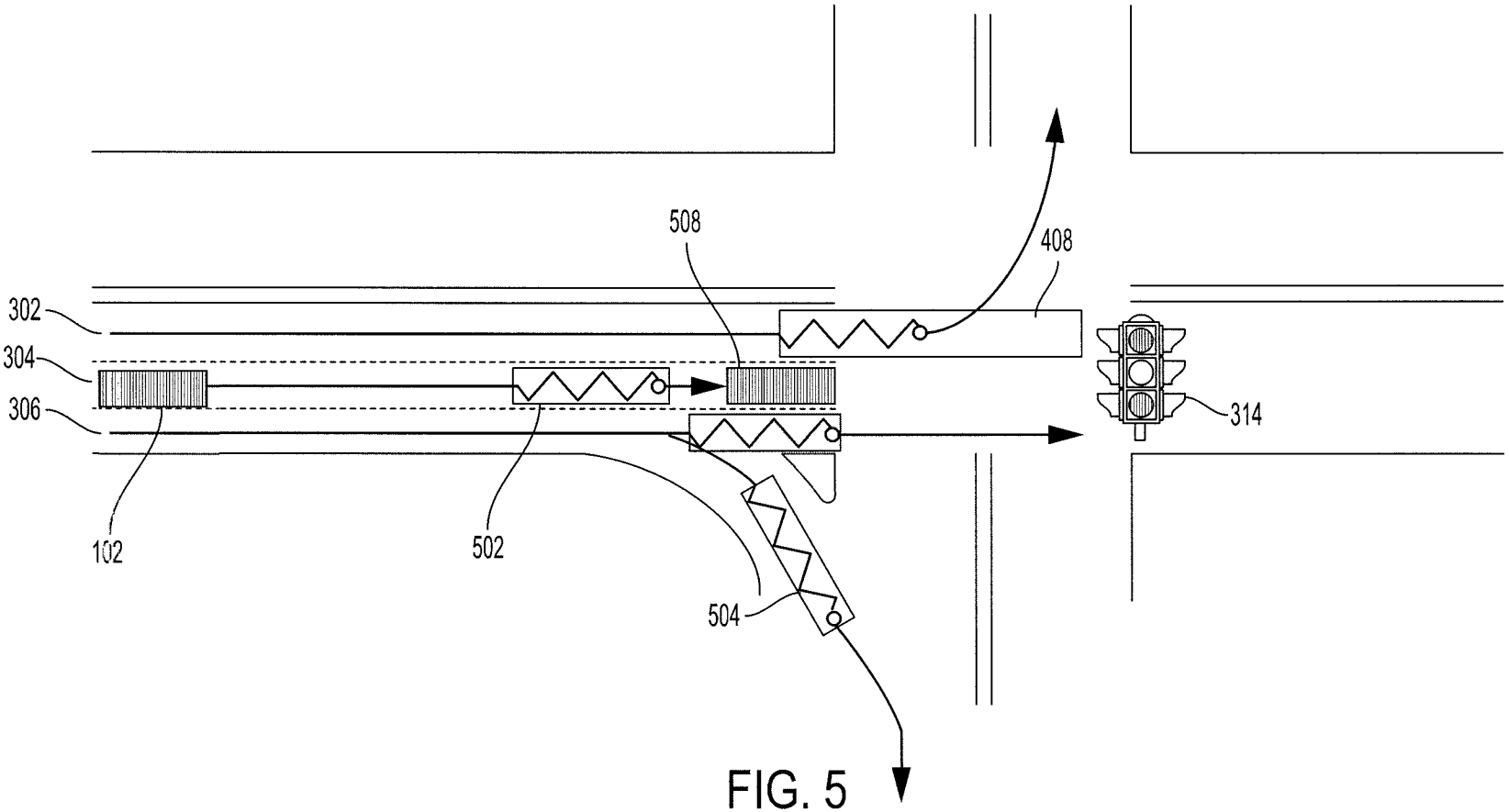
FIG. 5 is an example illustration of traffic within a stopping area of a stop event for one or more lanes according to an aspect of the invention.

FIG. 5 is an example illustration of a stopping area for one or more vehicles for a third state of a stop event 314. The third state of the stop event 314 may be a green left turn signal for a first lane 302, a red light signal for a second lane 304, and a yield signal for a third lane 306. The stop area 408 for the lane 302 may encroach within the intersection so that the vehicle 102 may reach a complete or partial stop in the middle of the intersection to make a left turn. Lane 306 may have a partial stop area 504 where the vehicle 102 decelerates but does not come to a complete stop. The coasting guidance system 100 may adjust the stop area 502 based on traffic condition information for the lane 304 so that the vehicle 102 stops before reaching the vehicle 508 which is at a standstill at the location of the stop event 314.

Exemplary embodiments of the methods/systems have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A coasting guidance system for a vehicle, comprising:

a user interface for displaying coasting information; and an electronic control unit coupled to the user interface and configured to:

obtain a current location of the vehicle and a location of a respective lane of a plurality of lanes, determine that the vehicle is travelling in the respective lane based on the current location of the vehicle and location of the respective lane, determine a stop area of the respective lane, determine an ideal coasting location based on the stop area, and provide a notification to begin coasting at or within a threshold distance of the ideal coasting location.

2. The coasting guidance system of claim 1, wherein each lane of the plurality of lanes has a stop area, wherein the stop area of each lane of the plurality of lanes is different than at least one other stop area of another lane of the plurality of lanes, wherein determining the stop area of the respective lane is based on a location of a stop event.

3. The coasting guidance system of claim 2, wherein the stop area begins a first distance before the stop event and extends a second distance past the stop event, wherein the stop event is of a particular type of a plurality of types, wherein the plurality of types includes a traffic signal.

4. The coasting guidance system of claim 3, wherein the electronic control unit is configured to determine the stop area of the respective lane further based on the particular type.

5. The coasting guidance system of claim 2, further comprising:

one or more external databases for providing navigational map information and traffic condition information;

wherein the electronic control unit is further configured to:

obtain the navigational map information and the traffic condition information from the one or more external databases, and determine the location of the stop event from the navigational map information.

6. The coasting guidance system of claim 5, wherein the electronic control unit is configured to determine that a roadway has the plurality of lanes based on the navigational map information.

7. The coasting guidance system of claim 1, wherein the electronic control unit is further configured to determine the stop area for the respective lane based on traffic in the respective lane.

8. The coasting guidance system of claim 1, further comprising:

a navigation unit configured to obtain a current location of the vehicle; and a memory configured to store a plurality of locations of stop events;

wherein to determine the stop area the electronic control unit is configured to:

compare the current location of the vehicle with each stored location of the plurality of locations of stop events stored in the memory, and match the current location of the vehicle to one of the plurality of stored locations of stop events.

9. The coasting guidance system of claim 1, wherein the notification is provided through the user interface.

10. A method for providing a notification to begin coasting, comprising:

obtaining a current location of a vehicle and lane information;

determining that the vehicle is in a respective lane of a plurality of lanes based on the current location of the vehicle and the lane information;

determining a location of a stop area of the respective lane of the plurality of lanes, each lane of the plurality of lanes having a stop area, the stop area of the respective lane being different than at least one stop area of another lane of the plurality of lanes;

determining an ideal coasting location based on the stop area of the respective lane; and providing a notification to begin coasting at or within a proximity of the ideal coasting location.

11. The method of claim 10, wherein providing the notification to begin coasting at or within the proximity of the ideal coasting location includes displaying an indication on a user interface.

12. The method of claim 10, wherein determining the ideal coasting location based on the stop area of the respective lane is based on traffic located in the respective lane.

13. The method of claim 10, wherein the stop area of the respective lane is based on a respective state of the plurality of states of a stop event.

14. The method of claim 10, wherein determining the location of the stop area of the plurality of lanes includes obtaining the location of the stop area from at least one of a memory that previously stored the location of the stop area or a navigation unit.

15. The method of claim 14, wherein determining the location of the stop area of the plurality of lanes includes obtaining the location of the stop area from navigational map information that is obtained using the navigation unit.

16. The method of claim 10, further comprising:

detecting traffic within the respective lane at or within a threshold distance of the stop area; and adjusting the stop area of the respective lane based on the detected traffic.

17. A coasting guidance system for a vehicle, comprising:

a user interface for displaying coasting information; and an electronic control unit coupled to the user interface and configured to:

determine that a roadway has a plurality of lanes, determine a respective lane of the plurality of lanes that the vehicle is travelling in based on a current location of the vehicle and lane information, determine a location of a stop event for the respective lane of the plurality of lanes that the vehicle is travelling in, determine a stop area of the respective lane, determine an ideal coasting location based on the stop area of the respective lane, and provide a notification to the user interface to begin coasting at or within a proximity of the ideal coasting location.

18. The coasting guidance system of claim 17, wherein the stop area of the respective lane is different than a stop area of another lane of the plurality of lanes.

19. The coasting guidance system of claim 17, further comprising:

one or more sensors for detecting other vehicles in a vicinity of the vehicle;

wherein the electronic control unit is further configured to determine the stop area of the respective lane based on one or more locations of the other vehicles.

20. The coasting guidance system of claim 17, wherein to determine the location of the stop event, the electronic control unit is configured to obtain, from one or more external databases, navigational map information including the location of the stop event.

* * * * *